US011719051B2

(12) United States Patent
Pronk

(10) Patent No.: US 11,719,051 B2
(45) Date of Patent: Aug. 8, 2023

(54) CABLE GUARD FOR SECURING CABLES TO DOWNHOLE SYSTEMS

(71) Applicant: Branden Pronk, Midland, TX (US)

(72) Inventor: Branden Pronk, Midland, TX (US)

( * ) Notice: Subject to any disclaimer, the term of this patent is extended or adjusted under 35 U.S.C. 154(b) by 0 days.

(21) Appl. No.: 17/736,680

(22) Filed: May 4, 2022

(65) Prior Publication Data

US 2022/0356765 A1 Nov. 10, 2022

Related U.S. Application Data

(60) Provisional application No. 63/184,634, filed on May 5, 2021.

(51) Int. Cl.

| | |
|---|---|
| ***E21B 17/02*** | (2006.01) |
| ***E21B 43/12*** | (2006.01) |
| ***E21B 17/00*** | (2006.01) |
| ***E21B 17/10*** | (2006.01) |

(52) U.S. Cl.

CPC ..... *E21B 17/026* (2013.01); *E21B 17/003* (2013.01); *E21B 17/10* (2013.01); *E21B 43/128* (2013.01); *E21B 17/023* (2013.01); *E21B 17/028* (2013.01)

(58) Field of Classification Search

CPC ..... E21B 17/026; E21B 17/003; E21B 17/10; E21B 43/128; E21B 17/023; E21B 17/028; F04D 13/10; F04D 25/0693

See application file for complete search history.

(56) References Cited

U.S. PATENT DOCUMENTS

| | | | | |
|---|---|---|---|---|
| 7,666,013 | B1 * | 2/2010 | Kopecky | H02K 5/132 439/191 |
| 2001/0000041 | A1 * | 3/2001 | Selmon | A61B 17/3207 600/585 |
| 2008/0308281 | A1 * | 12/2008 | Boutwell, Jr. | E21B 29/04 166/385 |
| 2009/0078020 | A1 * | 3/2009 | Baxter | B21D 43/28 72/379.4 |
| 2009/0126162 | A1 * | 5/2009 | Head | F16L 3/233 24/115 K |
| 2011/0303419 | A1 * | 12/2011 | Maier | E21B 33/126 166/373 |
| 2012/0312552 | A1 * | 12/2012 | Rayssiguier | E21B 17/023 166/380 |

(Continued)

*Primary Examiner* — Robert E Fuller
*Assistant Examiner* — Neel Girish Patel
(74) *Attorney, Agent, or Firm* — Holzer Patel Drennan

(57) ABSTRACT

An improved cable guard and methods of use are provided for securing an MLE cable to an ESP system in a wellbore casing, the system having flange bolts and an annular channel. The cable guard may be unitary (i.e., one piece), comprising a body having a bridge portion and two side portions forming a cavity for securing the cable to the system, two connectors extending from the side portions, each connector forming at least one aperture for receiving a flange bolt, and skids extending from the side portions for guiding movement of the system within the casing. In some embodiments, methods of using the improved cable guard may comprise providing the cable guard, positioning the cable guard to receive the cable within the cavity and to receive at least one flange bolt within an aperture, and securing the cable guard to the system.

10 Claims, 5 Drawing Sheets

(56) References Cited

U.S. PATENT DOCUMENTS

| | | | | |
|---|---|---|---|---|
| 2016/0024860 | A1* | 1/2016 | Semple | E21B 43/128 166/105 |
| 2016/0097243 | A1* | 4/2016 | Noakes | E21B 43/128 166/243 |
| 2017/0070119 | A1* | 3/2017 | Lee | H02K 5/22 |
| 2018/0148983 | A1* | 5/2018 | Hagen | F16L 3/06 |
| 2018/0283166 | A1* | 10/2018 | McCoy | E21B 17/026 |
| 2019/0390528 | A1* | 12/2019 | Angers, Jr. | E21B 23/01 |
| 2020/0032593 | A1* | 1/2020 | Serafinchan | E21B 17/1035 |
| 2020/0123865 | A1* | 4/2020 | Fundytus | G01V 1/52 |
| 2021/0095673 | A1* | 4/2021 | Forsberg | F04B 47/00 |
| 2021/0238945 | A1* | 8/2021 | Angers, Jr. | E21B 33/12 |
| 2021/0372205 | A1* | 12/2021 | Powers | E21B 17/02 |
| 2022/0106852 | A1* | 4/2022 | Schneider | E21B 33/12 |
| 2022/0307328 | A1* | 9/2022 | Akchurin | E21B 17/026 |
| 2023/0039223 | A1* | 2/2023 | Ortiz | F16B 7/0433 |

* cited by examiner

CABLE GUARD FOR SECURING CABLES TO DOWNHOLE SYSTEMS

CROSS-REFERENCE TO RELATED APPLICATIONS

This application claims the benefit of priority to U.S. Provisional Patent Application Nos. 63/184,634 filed May 5, 2021, entitled "APPARATUS AND METHODOLOGIES FOR ATTACHMENT AND PROTECTION OF CABLES", which is specifically incorporated by reference herein for all that it discloses or teaches.

FIELD

Embodiments herein are generally related to the attachment and protection of cables that are secured to production tubing, and specifically to cable guards for attaching and protecting power cables (e.g., motor lead cables, MLE) that transmit power to downhole electric submersible pump (ESP) systems.

BACKGROUND

The electrical submersible pump, commonly referred to as an "ESP", is an efficient and reliable artificial lift method for lifting moderate to high volumes of fluids from wellbores. In a typical application, having regard to FIG. 1 (PRIOR ART), ESPs are driven by a motor which, in combination with the ESP and other related componentry (e.g., seals, sensors, etc.) form an ESP system. The ESP system is installed at the lower end of a tubing string and run downhole through the wellbore casing, and is powered through a power cable running from the surface to the motor, driving the ESP to pump oil from the reservoir up to the surface. Such power cables (and/or other cables run parallel with the power cable) may serve additional purposes, including facilitating communication between the ESP system and controllers/operating systems at the surface.

Power cables that supply electrical power to a motor within an ESP system are referred to as motor lead extension ("MLE") cables. MLE cables are typically configured to run along the external surface of the system, which subjects the MLE cables to damage from contact with the wellbore, casing, or edges and joints of the tubing string. Most damage occurs to the MLE cables during the process of moving an ESP system into and out of the downhole operating location. For example, during downhole travel, particularly when entering the wellhead or traversing a build portion of a horizontal well, contact between an MLE cable and the casing, wellbore, or tubing string may damage or in some cases destroy the MLE cable. Moreover, a damaged or destroyed MLE cable may restrict or prevent proper operation of the motor or may render the MLE cable more susceptible to premature failure during operations, limiting the operational lifespan of the ESP system.

Many forms of MLE cable guards exist for securing MLE cables to the external surface of the ESP system and downhole tubing string. Some MLE cable guards provide a sleeve/collar, a two-piece clamp, or an articulating clamp for securing the MLE cables by wrapping substantially around the ESP system or tubing string. These MLE cable guards can only be installed during assembly of the ESP and motors within the ESP system, which can make installation more cumbersome and time consuming. Moreover, such cable guards can be large, cumbersome pieces that can become caught on pipe joints, or can cause resistance or become stuck during installation of the ESP assembly (particularly where clearance within the wellbore can be as small as one tenth of an inch). These large cable guards also prevent the use of multiple cable guards or other componentry at the same position along the ESP system or tubing string, which further limits their application. Other MLE cable guards have been held in place using screw fasteners secured to the exterior of the ESP system (e.g., U.S. Pat. No. 7,666,013; PCT/US2015/044966). Installation of these MLE cable guards is restricted to locations at or near the pump housing, or at a point near the motor bracket of the pump. Moreover, such cable guards can also require the use of multiple holes drilled directly into the pump housing for receiving and further securing and/or protecting the MLE cable, which tends to decrease the structural integrity of the ESP system. To date, known MLE cable guards are typically manufactured by investment casting using carbon or stainless steel, which can be subject to corrosion or scaling, or damaged by the harsh wellbore environment (e.g. sand, fracing fluids).

ESP systems are assembled in the field to allow for, among other things, separate transport of large ESPs and motors. As a result, installation of MLE cable guards can become troublesome, time-consuming, or a problematic step in the overall installation, particularly where parts are not manufactured within specific tolerances enabling easy alignment of components for quick assembly in the field.

There remains a need for an improved, simple MLE cable guard operative to both secure and protect the cable. It is desirable that such a cable guard does not encircle the ESP system or tubing string and does not fasten to the ESP system via drilled holes or otherwise. It is also desirable that such a cable guard may be easily installed in the field without customization of the cable guard or interference with the ESP system.

SUMMARY OF INVENTION

According to embodiments, an improved cable guard and methods of use are provided for securing a cable to an exterior surface of a downhole system in a wellbore casing, the external surface of the system having a plurality of flange bolts and at least one annular channel. The cable may be an MLE cable and the downhole system may be an ESP system.

In some embodiments, the improved cable guard may be unitary (i.e. one piece), comprising a body having a bridge portion and at least two laterally opposed side portions extending therefrom forming a cavity for securing the cable to the system, at least two connectors extending from the side portions, each connector forming at least one aperture for corresponding with and slidably receiving at least one flange bolt, and at least one skid extending from the side portions for guiding movement of the downhole system within the casing.

In some embodiments, the cable may be received within the cavity proximate to and in coaxial alignment with the downhole system.

In some embodiments, each one of the at least two connectors may form two or more apertures.

In some embodiments, the guard may further comprise at least one insert for slidably engaging the at least one annular channel. The at least one insert may extend radially inwardly from at least one of the at least one skid.

In some embodiments, methods of using the improved cable guard may comprise providing the cable guard, positioning the cable guard to receive the cable within the cavity in coaxial alignment with the system and to slidably receive the at least one flange bolt within the at least one aperture, and securing the cable guard to the system.

In some embodiments, the securing of the cable guard to the system may comprise threadably engaging the at least one flange bolt to the system.

In some embodiments, wherein the cable guard further forms at least one insert, the positioning of the cable guard may comprise situating the at least one insert within the at least one annular channel.

It is contemplated that the improved cable guard and methods of use may be operative to both secure and protect the cable, without encircling the ESP system, without fastening to the ESP system via drilled holes or otherwise, and while permitting the easy installation of the cable guard in the field without customization of the cable guard to interference with the ESP system.

DESCRIPTION OF EMBODIMENTS

According to embodiments, an improved cable guard and method of use for securing a cable to an exterior surface of a downhole system in a wellbore casing are provided. The present cable guard is configured for easy installation to the external surface of the system, i.e., for releasably attachment to a plurality of flange bolts and at least one annular channel on the system. In this manner, the presently improved cable guard can be readily affixed to any ESP system known in the industry.

Figure 1:
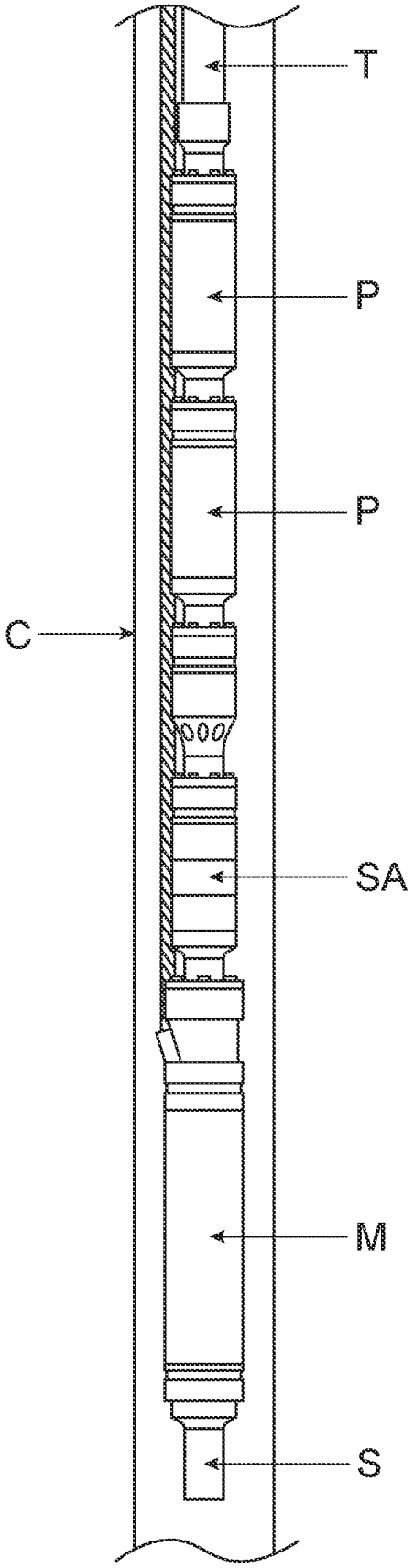
Fig. 1 (Prior Art)
FIG. 1 (PRIOR ART) provides an example ESP system showing a motor lead extension cable extending along an external surface of the ESP system, according to embodiments.

By way of background, having regard to FIG. 1 (PRIOR ART), ESP systems are typically positioned at the lower end of a tubing string T and run into a standard wellbore casing C. Such systems commonly include at least one pump P, pump motor M, seal assembly SA, sensor S, etc., joined together in various configurations, as desired. ESP systems are also known to include, without limitation, a variable speed drive, a controller/operating system, and other componentry located on the surface (not shown).

As will be appreciated, the pump(s) P, pump motor(s) M, sensor(s) S, and other componentry of ESP systems may require an electrical connection with the surface. Such connections may be provided by a cable (e.g., an MLE cable), which is run along an exterior surface of the system. MLE cables, which typically comprise a three-phase power cable, serve to provide power and communication between the downhole system components and the controller/operating system on the surface.

Given the harsh nature of the downhole environment, cable guards are used to protect and secure MLE cables to the exterior surface of system. Such cable guards must be sufficiently robust to endure extremely high pressures and temperatures, as well as aggressive chemicals with corrosive properties (e.g., particulates in the well fluids that can cause abrasion to the hardware, etc.), without limiting the system downhole and without interfering with other downhole operations.

In the present description, the terms "above/below", "upper/lower", "uphole/downhole", are used for ease of understanding and are generally intended to describe the relative positioning and/or orientation of an element within a wellbore (or, alternatively, within an ESP system oriented as if it were run into a wellbore). The terms "inner/outer", "inwardly/outwardly", and "interior/exterior", are used for ease of understanding and are generally intended to describe the distance of an element from the longitudinal axis of the wellbore (or, alternatively, from the exterior surface of an ESP system).

The present cable guard 10 and methodologies will now be described having regard to FIGS. 1-4.

According to embodiments, the present description relates to an improved, unitary (i.e., one piece), low-profile cable guard 10 for securely affixing at least one cable 12 (e.g., an MLE cable, control line, cap string, etc.), to an exterior surface of an ESP system 14. For example, cable guard 10 may form a robust, rigid (i.e. non-articulating), streamlined clamp that can be readily secured to system 14 by engaging pre-existing flange bolts 16 located at each joint 18 of system 14. Cable guard 10 may further serve to protect cable(s) 12 while assisting with running system 14 downhole or with retrieving system 14 during fishing operations.

In some embodiments, cable guard 10 may be manufactured to endure a harsh environment over extended periods of time. For example, without limitation, guard 10 may comprise a metal, an alloy, a composite, a polymer, or a combination thereof, such that guard 10 may be molded, extruded, or 3D-printed, or otherwise manufactured using any combination of said methods. Advantageously, it is contemplated that guard 10 may be manufactured in a manner and from materials such that the guard 10 may be easily fished from the wellbore and/or may be drilled out where desired. Moreover, guard 10 may be cost-effectively mass produced without requiring any customization. It would be appreciated by those skilled in the art that the longevity of system 14, cable 12, and any associated downhole componentry can depend on the environment and the capacity of the componentry to endure same.

Figure 2A:
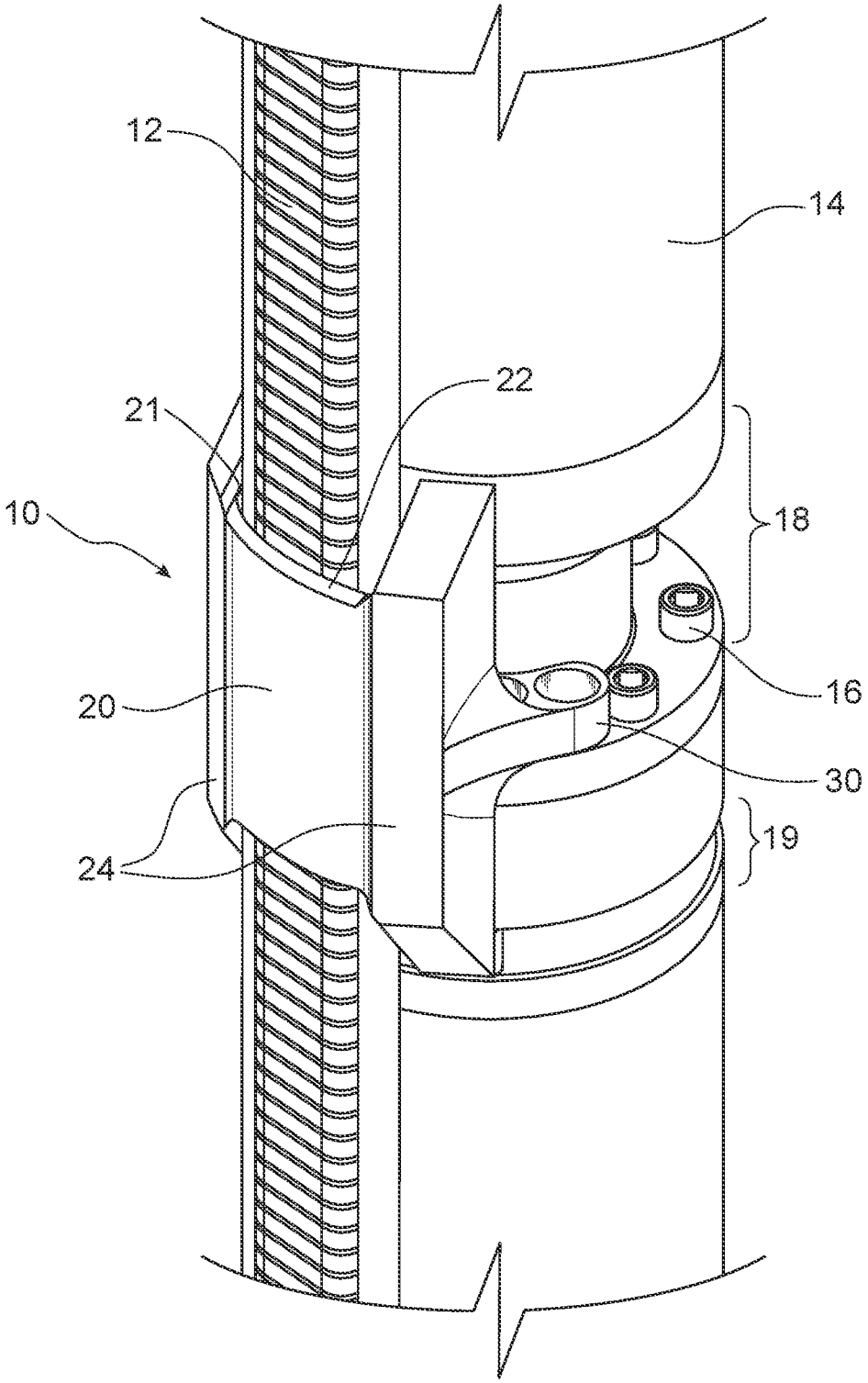
FIGS. 2A and 2B provide perspective and front views, respectively, of the present cable guard secured to the ESP system shown in FIG. 1, according to embodiments, FIGS. 2A and 2B referred to collectively herein as FIG. 2.
Figure 2B:
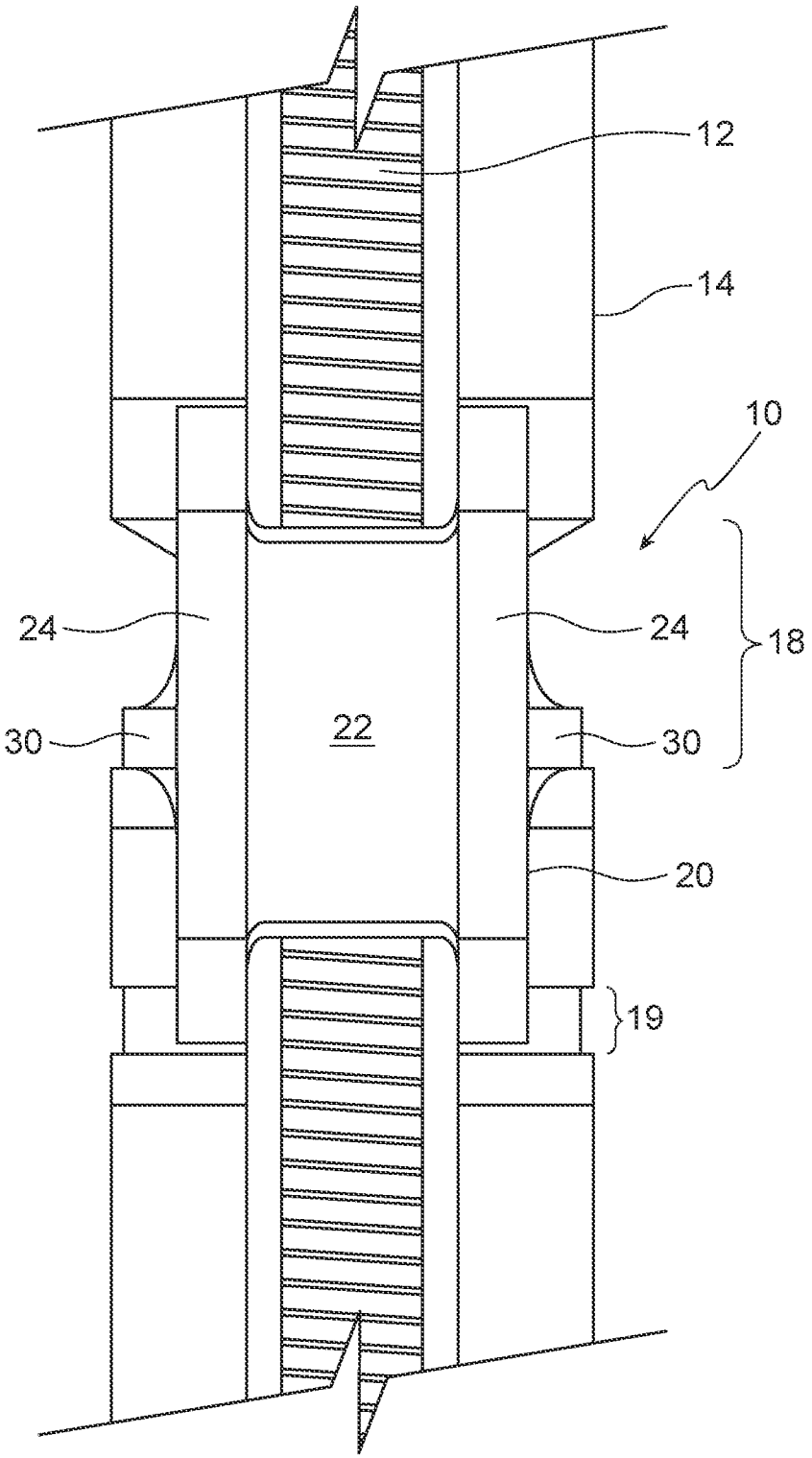

In some embodiments, having regard to FIG. 2, an improved cable guard 10 is shown securing (i.e., positioning) a cable 12 to system 14. Guard 10 comprises a body 20 forming a cavity 21 for receiving, covering, and securing the cable 12 proximate to, and in coaxial alignment with, system 14.

In some embodiments, body 20 may be substantially U-shaped, comprising a bridge portion 22 and at least two opposed side portions 24 extending radially inwardly therefrom (when viewed from above). As will be appreciated, bridge portion 22 and side portions 24 each have an interior surface and an exterior surface (not shown). The interior surface of bridge portion 22 and side portions 24, in combination with the exterior surface of system 14, form cavity 21 for securely receiving cable 12 therein. The exterior surface of bridge portion 22 and side portions 24 provides a substantially smooth, low profile relative to outer surface of system 14.

In some embodiments, bridge portion 22 may be substantially rectangular in shape (when viewed from the front) having a top, a bottom, and two side edges. Each opposed side portion 24 may extend laterally outwardly from one side edge (when viewed from the front).

In some embodiments, for example, laterally opposed side portions 24 are configured to provide at least three functions, namely: to affix cable guard 10 to system 14, to provide skids operative to assist movement of system 14 within casing C, and to extending across joints 18 in system 14 (e.g., shielding at least a portion of joints 18 between componentry of system 14 and providing additional support for cable guard 10).

Figure 3:
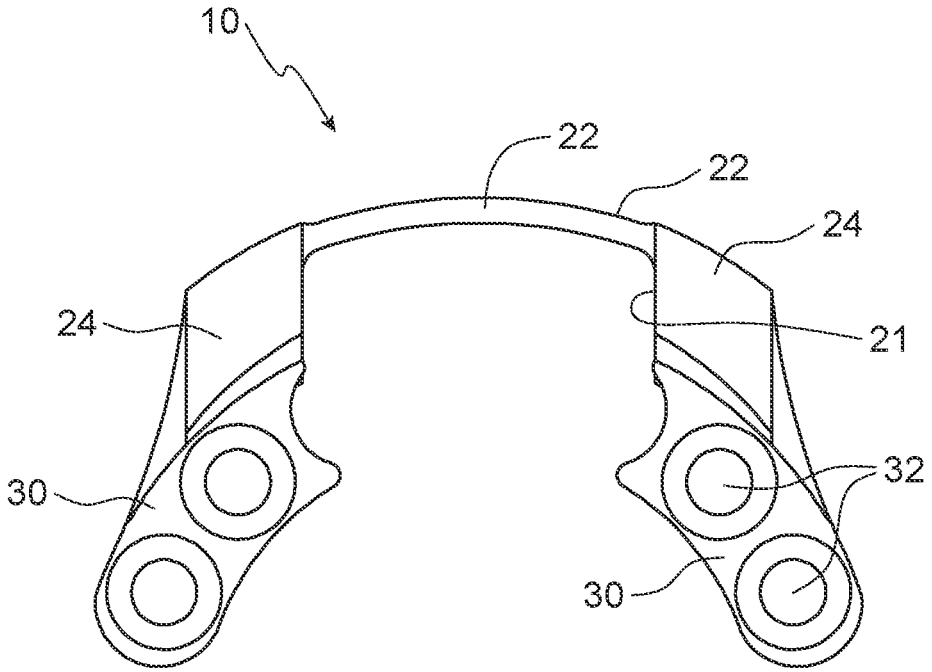
FIG. 3 provides a top view of the present cable guard shown in FIG. 2, according to embodiments.

According to embodiments, having regard to FIG. 3, each side portion 24 may comprise at least one connector 30 for affixing guard 10 to system 14. In some embodiments, connector(s) 30 may extend laterally outwardly from side portions 24 (when viewed from the front) and radially inwardly from side portions 24 (when viewed from the top), further encircling system 14. Advantageously, connector(s) 30 may form at least one aperture 32 configured to align with and slidably receive a corresponding pre-existing flange bolt 16 of system 14. For example, as desired, each connector(s) 30 extending from body 20 may comprise one, two, or a plurality of apertures 32, for use with ESP systems having varying bolt patterns (e.g., six or eight bolt patterns), without requiring any custom modifications to be made to guard 10 and eliminating the need to drill holes into system 14 to receive new bolts, screws, or other fasteners. Moreover, advantageously, guard 10 may be easily installed without fully encircling or clamping onto the ESP system 14, while maintaining structural integrity of system 14, and while resisting detachment of guard 10 from system 14.

Figure 4:
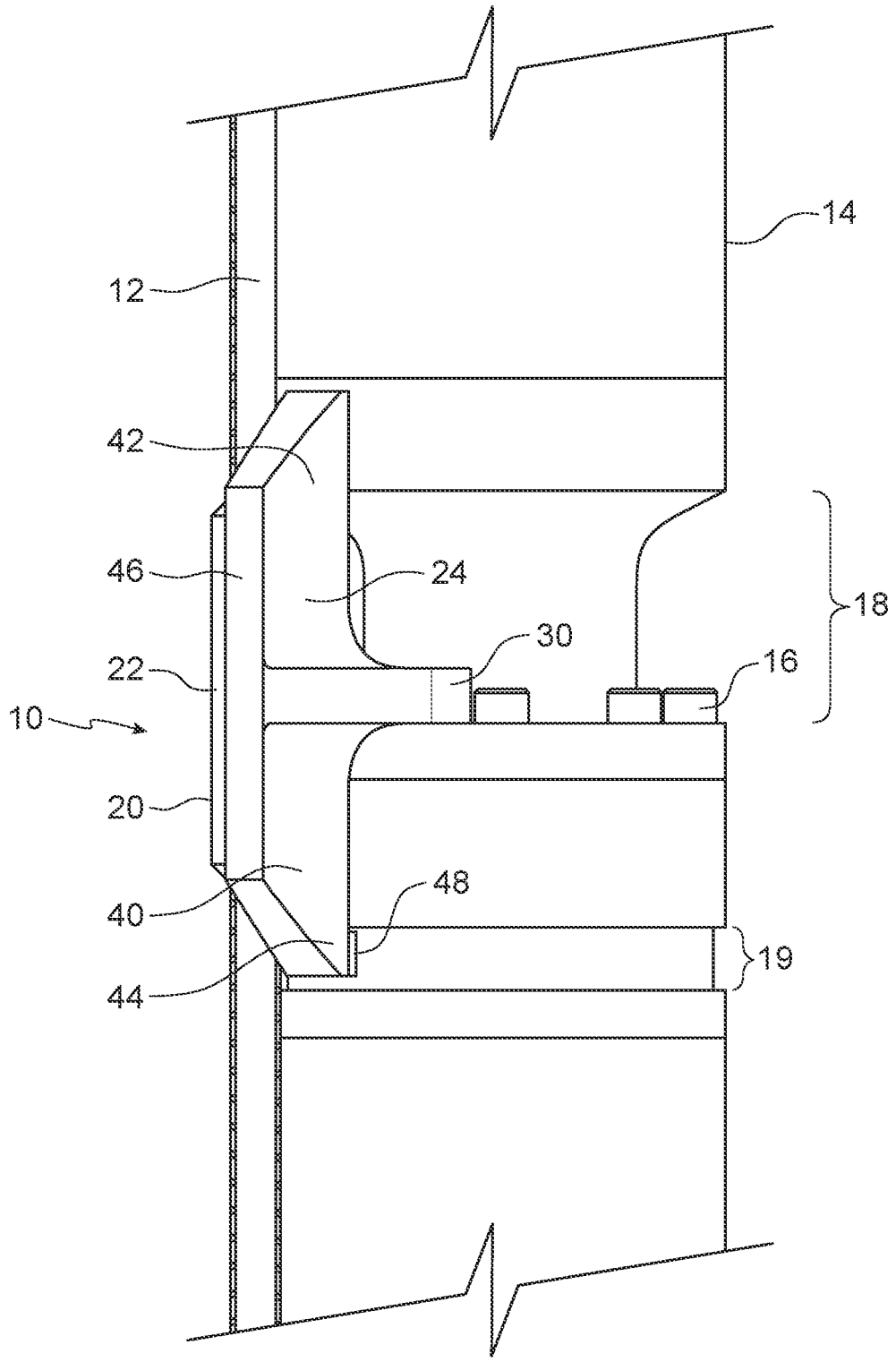
FIG. 4 provides a side view of the present cable guard secured to the ESP system shown in FIG. 2, according to embodiments.

According to embodiments, having regard to FIG. 4, each side portion 24 may be comprise at least one skid 40 for guiding movement of system 14 within casing C. In some embodiments, skid(s) 40 may have an uphole and a downhole portion, 42,44, respectively, and an outer surface 46. At least a portion of outer surface 46 may align with exterior surface of bridge 22 to maintain the substantially smooth, low profile of guard 10, and at least one other portion of outer surface 46 may taper inwardly relative to a longitudinal axis of the wellbore (i.e., towards outer surface of system 14) to prevent snagging between guard 10 and casing C.

According to embodiments, skid(s) 40 may further form a positioning means for conveniently positioning guard 10 relative to system 14, as desired. For example, having further regard to FIG. 4, uphole and downhole portions 42,44 may form at least one channel insert 48 for slidably engaging annular channel 19 of joint 18. Annular channel 19 may be a pre-existing channel encircling the head of a component of the ESP system 14 (e.g. pump P, motor M, etc.). Such channels are known in the art and are typically used with lifting clamps (not shown) during installation and pulling operations of the ESP system. As would be appreciated, such channels are configured to resist jarring and torsional forces applied to the component of the ESP system 14 by the lifting clamps (not shown).

In some embodiments, channel insert 48 may be configured to extend radially inwardly (e.g., relative to the longitudinal axis of the wellbore) into channel 19 and be dimensioned so as to interface with channel 19. As will be appreciated, interfacing of channel insert 48 with channel 19 may prevent axial (e.g., uphole/downhole) movement of guard 10 relative to system 14 and, further, resist misalignment and decoupling of guard 10 from system 14. More specifically, insert 48 may provide an uphole and downhole shoulder abutting channel 19 such that, when insert 48 is situated within channel 19, insert 48 abuts channel 19 to prevent inadvertent movement of guard 10 relative to system 14. Advantageously, guard 10 may be configured so that insert 48 does not interfere with the use of lifting clamps during installation of the ESP system and subsequent pulling operations.

According to embodiments, the present methods for securing a cable to an exterior surface of a downhole system 14 in a wellbore casing C, the external surface of system 14 having a plurality of flange bolts 16 and at least one annular channel 19 may comprise providing a unitary cable guard 10 having a body 20 forming a cavity 21 for securing a cable to system 14, and at least two connectors 30 forming at least one aperture 32 for corresponding with and slidably receiving at least one flange bolt 16; positioning cable guard 10 to receive the cable within cavity 21 in coaxial alignment with the system 14 and to slidably receive flange bolt 16 within aperture 32; and securing cable guard 10 to system 14. Advantageously, cable guard 10 may be secured to system 14 alone or in conjunction with other known motor head adapters, MLE cable guards, and the like including, without limitation, the cable guards described in U.S. Pat. No. 7,666,013.

In some embodiments, having regard to FIG. 4, the securing of cable guard 10 to system 14 may comprise threadably engaging flange bolt 16 to system 14. In such embodiments, guard 10 may be installed at one or more joints 18 separating the componentry (e.g., pumps, pump motors, seal assemblies, etc.) of ESP system 14. More specifically, pre-existing flange bolts 16 installed at or near joints 18 of system 14 may be removed (e.g., threadably disengaged) from their corresponding pre-existing bolt holes (not shown) and guard 10 may be positioned such that at least one aperture 32 of connector 30 aligns with at least one pre-existing bolt hole of system 14. Once positioned, guard 10 may secured to system 14 by slidably positioning (e.g., by reinsertion and threadable reengagement of) at least one flange bolt 16 into the at least one pre-existing bolt hole through aperture 32. As will be appreciated, a bolt head, nut, weld, cotter pin, or other componentry in combination with flange bolt 16 may be provided (not shown) to prevent guard 10 from sliding off the at least one flange bolt 16 or otherwise disengaging from, or moving relative to, system 14.

In use, operator may select an any embodiment of guard 10 having an appropriate configuration of apertures 32 for connecting guard 10 to the at least one or more flange bolts 16 of system 14. That is, guard 10 may be selected to correspond with bolt pattern standard in the industry, e.g., two, four, six flange bolts 16, etc., without requiring customization. Moreover, it should be understood that guard 10 may be secured to system 14 by providing any configuration of connector 30 that is operable to engage any pre-existing component or geometry of system 14 without requiring customization of guard 10 or modification of system 14 (e.g., drilling holes into system 14), and while maintaining a unitary, rigid body.

In some embodiments, having further regard to FIG. 4, the positioning of cable guard 10 to receive the cable within cavity 21 in coaxial alignment with the system 14 may comprise situating at least one channel insert 48 formed by body 20 within annular channel 19. Advantageously, as will be appreciated, the situating of channel insert 48 within annular channel 19 may serve to position cable guard 10 at an appropriate height (i.e., uphole/downhole) relative to at least one joint 18, so as to permit convenient securing of gable guard 10 to system 14, as previously described.

In some embodiments, a plurality of cable guards 10 may be used in series along system 14 or tubing string T to secure the MLE cable along the length of tubing string T. In yet other embodiments, two or more cable guards 10 may be used at a single joint 18 to secure two or more MLE cables at different positions (e.g., diametrically opposed about the longitudinal axis of the wellbore) about the exterior surface of system 14 or tubing string T.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof.

I claim:

1. A unitary cable guard for securing a cable to an exterior surface of a downhole system in a wellbore casing, the exterior surface of the system having a plurality of flange bolts and at least one annular channel, the cable guard comprising:

a body having a bridge portion and at least two laterally opposed side portions extending therefrom forming a cavity for securing the cable to the system, at least two connectors extending from the side portions, each connector forming at least one aperture for corresponding with and slidably receiving at least one flange bolt, and at least one skid extending from the side portions for guiding movement of the downhole system within the casing.

2. The cable guard of claim 1, wherein the cable is received within the cavity proximate to and in coaxial alignment with the downhole system.

3. The cable guard of claim 1, wherein each one of the at least two connectors forms two or more apertures.

4. The cable guard of claim 1, wherein the guard further comprises at least one insert for slidably engaging the at least one annular channel.

5. The cable guard of claim 4, wherein the at least one insert extends radially inwardly from at least one of the at least one skid.

6. The cable guard of claim 1, wherein the cable is a motor lead extension cable.

7. The cable guard of claim 1, wherein the downhole system comprises an electrical submersible pump.

8. A method for securing a cable to an exterior surface of a downhole system in a wellbore casing, the exterior surface of the system having a plurality of flange bolts and at least one annular channel, the method comprising:

providing a unitary cable guard having a body forming a cavity for securing the cable to the system, and at least two connectors forming at least one aperture for corresponding with and slidably receiving at least one flange bolt, positioning the cable guard to receive the cable within the cavity in coaxial alignment with the system and to slidably receive the at least one flange bolt within the at least one aperture, and securing the cable guard to the system.

9. The method of claim 8, wherein the securing of the cable guard to the system comprises threadably engaging the at least one flange bolt to the system.

10. The method of claim 8, wherein the body further forms at least one insert and the positioning of the cable guard comprises situating the at least one insert within the at least one annular channel.

* * * * *